US006783292B2

(12) United States Patent
Arai et al.

(10) Patent No.: US 6,783,292 B2
(45) Date of Patent: Aug. 31, 2004

(54) DOUBLE-CHUCK MECHANICAL PENCIL

(75) Inventors: Sachio Arai, Saitama-ken (JP); Tadao Odaka, Saitama-ken (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/265,402

(22) Filed: Oct. 7, 2002

(65) Prior Publication Data

US 2003/0113154 A1 Jun. 19, 2003

(30) Foreign Application Priority Data

Dec. 14, 2001 (JP) ..... 2001-381049
Jul. 18, 2002 (JP) ..... 2002-209244

(51) Int. Cl.[7] ..... B43K 21/22
(52) U.S. Cl. ..... 401/92; 401/65; 401/67; 401/93
(58) Field of Search ..... 401/65, 67, 92, 401/93, 94, 95, 103, 112

(56) References Cited

U.S. PATENT DOCUMENTS 5,947,620 A * 9/1999 Kageyama et al. ..... 401/67
6,039,484 A * 3/2000 Kageyama et al. ..... 401/67
6,203,227 B1 * 3/2001 Noguchi ..... 401/92
6,382,859 B2 * 5/2002 Noguchi et al. ..... 401/92

FOREIGN PATENT DOCUMENTS

EP 1118476 A2 * 7/2001 ..... B43K/21/04

* cited by examiner

*Primary Examiner*—Tuan N. Nguyen
(74) *Attorney, Agent, or Firm*—Rothwell, Figg, Ernst & Manbeck

(57) ABSTRACT

A double-chuck mechanical pencil comprises a barrel, a barrel cap detachably attached to a front end of the barrel, a lead tank inserted in the barrel, a feed chuck for feeding leads, combined with the lead tank, a sleeve bolster disposed on the front side of the feed chuck, and a holding chuck combined with the sleeve bolster. A holding chuck unit including the holding chuck and the sleeve bolster, and a feed chuck unit including the feed chuck and a sleeve can come into contact with each other in the barrel cap.

1 Claim, 11 Drawing Sheets

DOUBLE-CHUCK MECHANICAL PENCIL

BACKGROUND OF THE INVENTION

The present invention relates to a double-chuck mechanical pencil provided with a feed chuck for feeding a lead, and a holding chuck for holding a lead.

Various double-chuck mechanical pencils intended to reduce the loss of leads have been proposed in recent years. Such a double-chuck mechanical pencil is provided with a feed chuck for feeding a lead and a holding chuck for holding a lead. The conventional double-chuck mechanical pencil is a complicated structure provided with a feed chuck mechanism and a holding chuck mechanism and, therefore, has the following problems.

If a barrel cap, which requires accurate machining, is found to be defective during the manufacture of a double-chuck mechanical pencil, it is difficult to replace the defective barrel cap with a good one because the double-chuck mechanical pencil has complicated construction and parts are supplied in units. Since the structural condition requires the parts to be assembled in a plurality of layers and hence the outside diameter of the internal mechanism of the double-chuck mechanical pencil is inevitably large, the double-chuck mechanical pencil cannot be formed in a small outside diameter.

When the user drops the double-chuck mechanical pencil inadvertently and the lead is broken in the chuck, the parts cannot be easily disassembled and it is difficult to remove the broken leads because the internal mechanism of the double-chuck mechanical pencil is a complete assembly of unit assemblies. If a conventional double-chuck mechanical pencil is dropped during transportation, a holding chuck placed in a barrel cap is deformed by shocks and becomes defective, and the lead is broken.

SUMMARY OF THE INVENTION

The present invention has been made to solve the foregoing problems in the conventional double-chuck mechanical pencils and it is therefore a first object of the present invention to provide a double-chuck mechanical pencil facilitating replacing a holding chuck found to be defective during a manufacturing process with a new one, and capable of being easily disassembled to remove broken leads when broken leads are jammed.

A second object of the present invention is to provide a double-chuck mechanical pencil including a barrel cap, a mechanical unit including a feed chuck, twisted in the barrel cap and fixed to the barrel cap by a stopper tube, and a front barrel which can be used in both a ballpoint pen and a mechanical pencil. The double-chuck mechanical pencil provided with the front barrel capable of being used in both a ballpoint pen and a mechanical pencil can be manufactured at a high productivity and facilitates process management.

A third object of the present invention is to provide a double-chuck mechanical pencil provided with a separate internal mechanism instead of a complete unit internal mechanism to reduce the eccentricity (thickness deviation) of molded parts including a sleeve bolster, a sleeve and a stopping tube, and facilitating aligning the axes of parts forming a lead passage.

When the foremost lead is worn out while a double-chuck mechanical pencil is used for writing and the next lead needs to be fed, it is desirable that a feed chuck is kept centered in a barrel as far as possible while the feed chuck feeds the next lead. For example, if the feed chuck is pressed obliquely in a lead tank or a high pressure that warps the lead tank is applied to the lead tank, the feed chuck vibrates to misalign the succeeding lead with the preceding lead and, consequently, the succeeding lead cannot be smoothly fed.

Accordingly, it is a third object of the present invention to provide a double-chuck mechanical pencil including a long barrel cap, a stopper tube disposed in a back part to reduce the bend of a lead tank when a pressure is applied to the lead tank and to reduce the vibration of a feed chuck, and capable of surely feeding a lead.

A fourth object of the present invention is to provide a double-chuck mechanical pencil having an internal mechanism formed in the least possible outside diameter, and formed in a small outside diameter.

A fifth object of the present invention is to provide a double-chuck mechanical pencil having a holding chuck placed in a barrel cap, and associated mechanisms. The holding chuck being capable of absorbing shocks and is resistant to deformation and hence leads are not easily broken.

According to one aspect of the present invention, a double-chuck mechanical pencil comprises: a barrel; a barrel cap attached to the front end of the barrel; a lead tank inserted in the barrel; a feed chuck for feeding leads, combined with the lead tank; a sleeve bolster disposed on the front side of the feed chuck; and a holding chuck combined with the sleeve bolster; wherein a holding chuck unit including the holding chuck and the sleeve bolster, and a feed chuck unit including the feed chuck and a sleeve can come into contact with each other in the barrel cap.

According to another aspect of the present invention, a double-chuck mechanical pencil comprises: a barrel; a barrel cap detachably attached to a front end of the barrel; a lead tank inserted in the barrel so as to be operated for longitudinal sliding in the barrel; a feed chuck directly or indirectly fixed to a front end of the lead tank; a chuck ring loosely put on the feed chuck; a sleeve interposed between the barrel cap and the feed chuck; a sleeve bolster in contact with a front end of the sleeve; a holding chuck fixed to the front end of the sleeve; a return spring interposed between the sleeve and the lead tank; a tip spring interposed between the barrel cap and the sleeve; a stopper tube surrounding the lead tank and engaged with a back end of the barrel cap.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
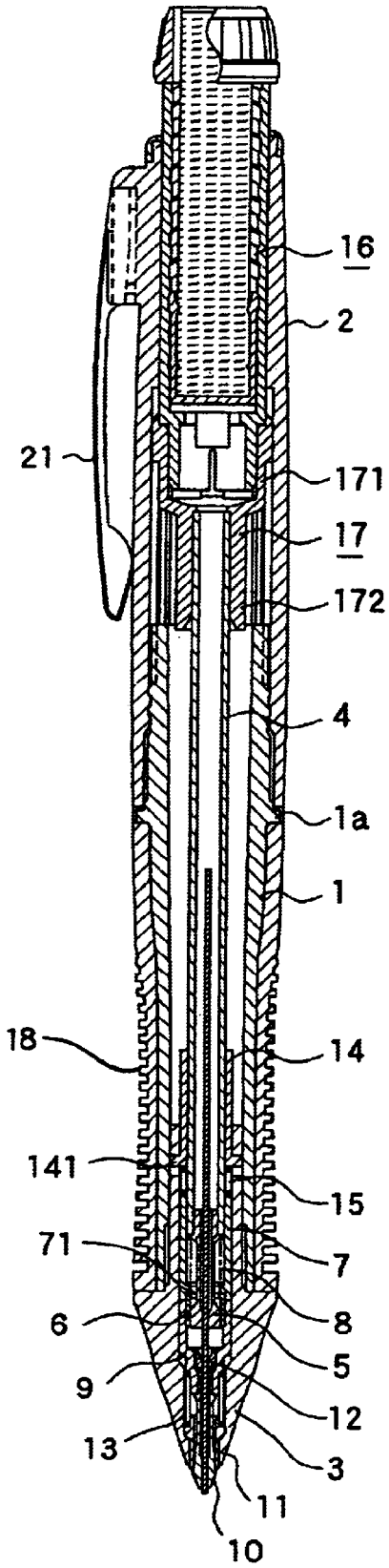
FIG. 1 is a longitudinal sectional view of a double-chuck mechanical pencil in a first embodiment according to the present invention.
Figure 2:
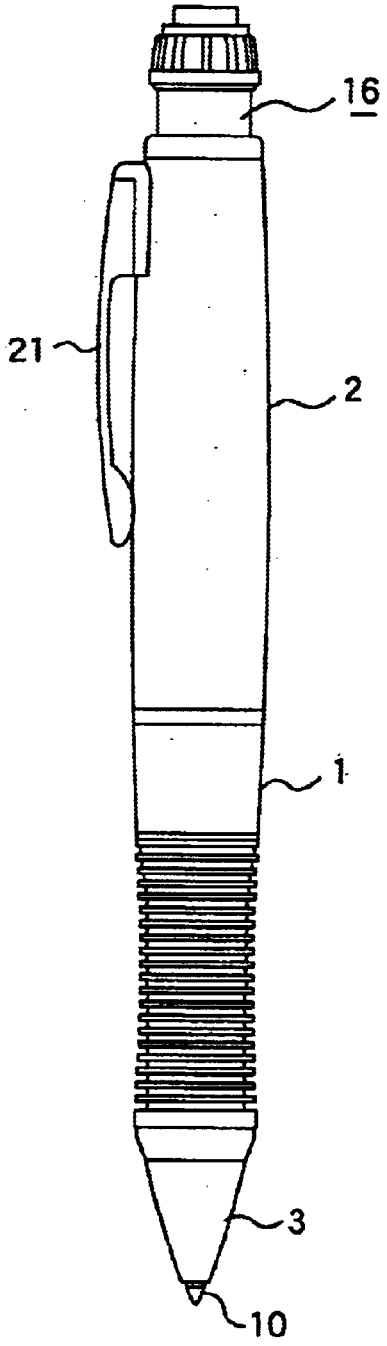
FIG. 2 is a front elevation of the double-chuck mechanical pencil shown in FIG. 1.

A double-chuck mechanical pencil in a first embodiment according to the present invention will be described with reference to FIGS. 1 to 14, in which FIGS. 1 and 2 show the double-chuck mechanical pencil, and FIGS. 3 to 14 show the component parts of the double-chuck mechanical pencil shown in FIGS. 1 and 2.

Referring to FIGS. 1 and 2, the double-chuck mechanical pencil has a barrel consisting of a front barrel 1 provided in its back part with a flange 1*a*, and a back barrel 2 having a front end contiguous with the flange 1*a*, and a clip 21. The front barrel 1 and the back barrel 2 are able to turn relative to each other. A barrel cap 3 is screwed in a front end part of the front barrel 1. The barrel cap 3 is detachable from the front barrel 1.

Referring to FIGS. 11 to 14, the barrel cap 3 has a joining part provided with an external thread 31 corresponding to an internal thread formed in a front end part of the front barrel 1, and a back part provided with a pair of openings 32 with which a pair of projections 141 formed on a stopper tube 14 engages. Each opening 32 has a guide section 321 longitudinally extending forward from the back end of the barrel cap 3, a circumferential section 322 circumferentially extending from the front end of the guide section 321, and a holding section 323 longitudinally extending backward from the dead end of the circumferential section 322.

Figure 13:
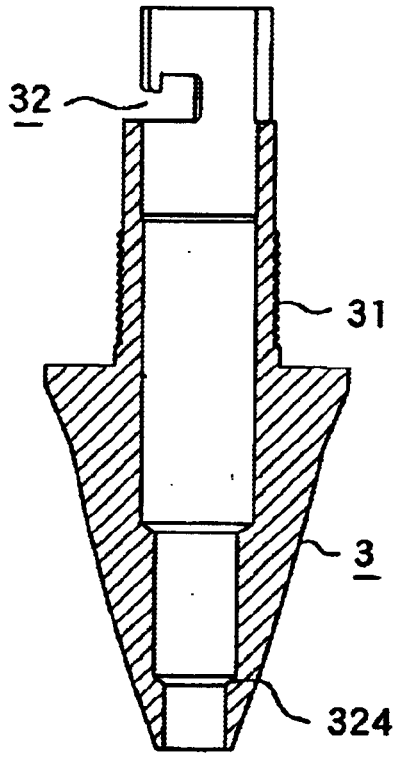
FIG. 13 is a sectional view taken on line D—D in FIG. 11.
Figure 14:
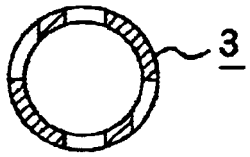
FIG. 14 is a sectional view taken on line C—C in FIG. 11.

To assemble the barrel cap 3 and the stopper tube 14, the pair of projections 141 of the stopper tube 14 are pushed into the guide sections 321 of the openings 32 to the respective front ends of the guide sections 321. Then the stopper tube 14 is turned in the direction of extension of the circumferential sections 322 from the front ends of the guide sections 321. Consequently, the projections 141 drop into the holding sections 323. In FIG. 13, the barrel cap 3 is internally provided with an annular step 324 on which a flange 111 formed in a tip sleeve 11 rests to retain the tip sleeve 11 in place.

A lead tank 4 containing a plurality of leads is axially slidably inserted in the barrel. A back end part of a feed chuck 5 is pressed in and fixed to a front end part of the lead tank 4. The feed chuck 5 has a chuck head split into three jaws. The chuck ring 6 is put on the chuck head. A sleeve 7 provided with an internal annular projection 71 is put on the feed chuck 5. A return spring 8 is extended between the internal annular projection 71 and the front end of the lead tank 4 to push backward the feed chuck 5 and the lead tank 4 together.

Figure 3:
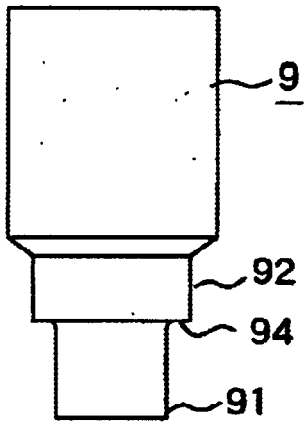
FIG. 3 is a front elevation of a sleeve bolster.
Figure 4:
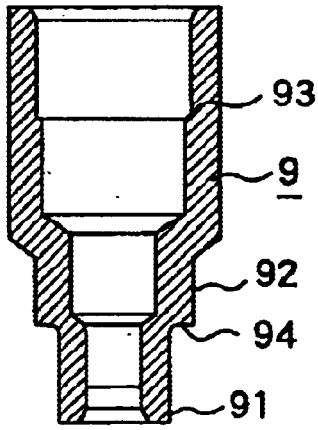
FIG. 4 is a longitudinal sectional view of the sleeve bolster shown in FIG. 3.

A sleeve bolster as shown in FIGS. 3 and 4 is disposed in contact with the front end of the sleeve 7. The sleeve bolster 9 has a front reduced attaching part 91. A holding chuck 10 for holding a lead is pressed in and fixed to the attaching part 91. A packing or an elastic, frictional member 12 is fitted in an intermediate part 92 extending backward from the attaching part 91. A back part of the sleeve bolster 9 is internally provided with an inner step 93 with which the chuck ring 6 comes into contact to open the holding chuck 10.

Figure 5:
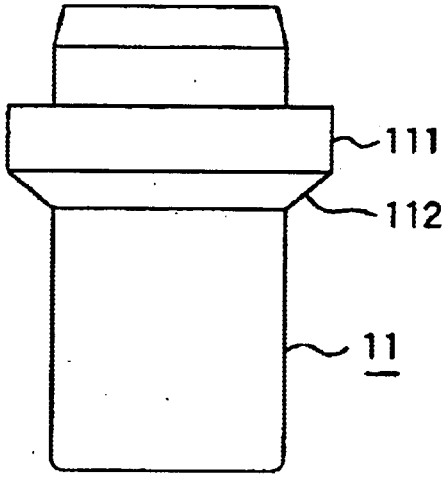
FIG. 5 is an enlarged front elevation of a tip sleeve.
Figure 6:
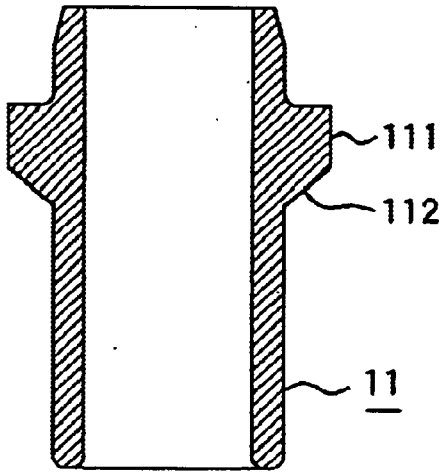
FIG. 6 is a longitudinal sectional view of the tip sleeve shown in FIG. 5.

The tip sleeve 11 shown in FIGS. 5 and 6 is disposed between the front end part of the barrel cap 3 and the holding chuck 10. When the tip sleeve 11 is inserted in the barrel cap 3, the flange 111 formed in the tip sleeve 11 rests on the annular step 324 to retain the tip sleeve 11 in place. The front end of the flange 111 is tapered forward so as to conform to the shape of the annular step 324 formed in the barrel cap 3.

A tip spring 13 is extended between the flange 111 of the tip sleeve 11 and a shoulder 94 formed in the attaching part 91 of the sleeve bolster 9. The tip sleeve 11 is fitted through a tip opening of the barrel cap 3 in a front end part of the barrel cap 3 to protect the front end part of the barrel cap 3. The holding chuck 10 is extended through the tip sleeve 11. The holding chuck 10 is provided with a stepped part that retains the holding chuck 10 on the tip sleeve 11 to prevent the holding chuck 10 from falling off the barrel cap 3.

The stopper tube 14 provided with the pair of projections 141 as shown in FIGS. 7 to 10 is inserted in the front barrel 1 so as to extend behind the sleeve 7. The projections 141 are engaged in the openings 32 formed in the back attaching part of the barrel cap 3 so as to line in the holding sections 323 of the openings 32. A plurality of longitudinal ridges 142 are formed on the outer surface of the stopper tube 14 to facilitate handling the stopper tube 14 during assembling work.

A cushioning spring 15 is extended between the front end of the stopper tube 14 and the sleeve 7 to absorb an excessive pressure applied to the lead. The cushioning spring 15 has not only a function of absorbing an excessive pressure applied to the lead but also a function of absorbing an impact exerted on the holding chuck 10 when the double-chuck mechanical pencil is dropped. Therefore, the holding chuck 10 is not easily deformed and the lead is not easily broken. That is, an impact exerted on the tip of the holding chuck 10 is transmitted through the sleeve bolster 9 connected to the holding chuck 10 to the sleeve 7. Since the cushioning spring is extended between the front end of the stopper tube 14 and the back end of the sleeve 7, the impulse is absorbed by the cushioning spring 15 and, consequently, the holding chuck 10 is not deformed and the lead is not broken.

Figure 7:
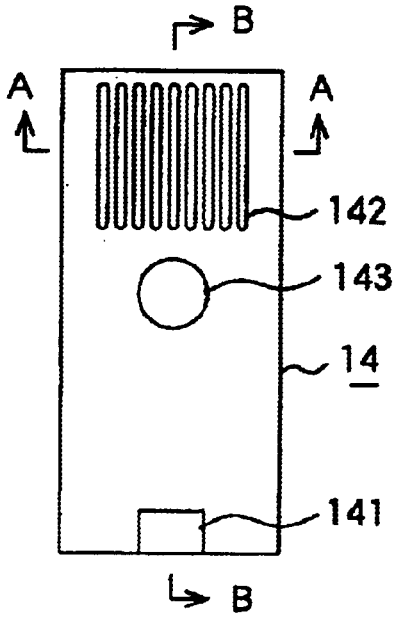
FIG. 7 is an enlarged front elevation of a stopper shown in FIG. 1.
Figure 8:
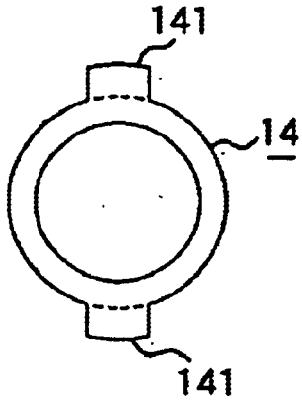
FIG. 8 is a bottom view of the stopper shown in FIG. 7.
Figure 9:
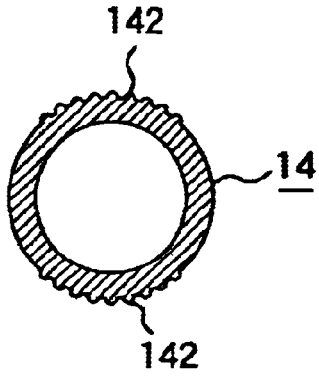
FIG. 9 is a sectional view taken on line A—A in FIG. 7.
Figure 10:
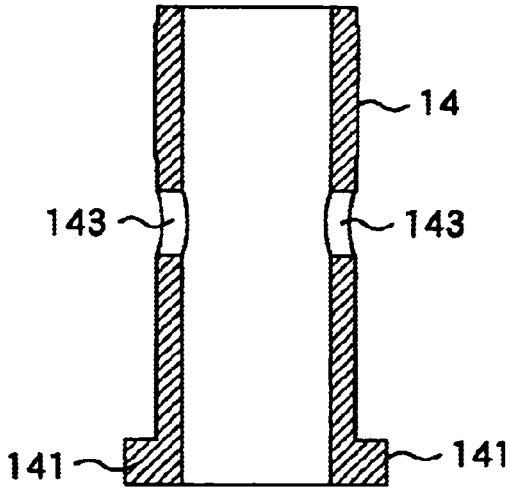
FIG. 10 is a longitudinal sectional view taken on line B—B in FIG. 7.
Figure 11:
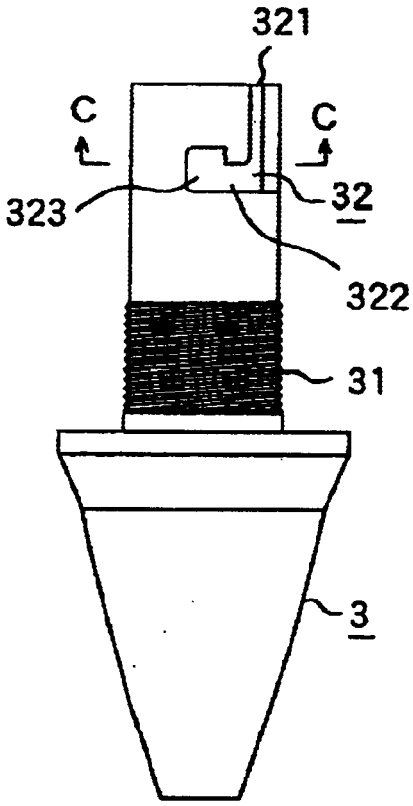
FIG. 11 is a front elevation of a barrel cap.
Figure 12:
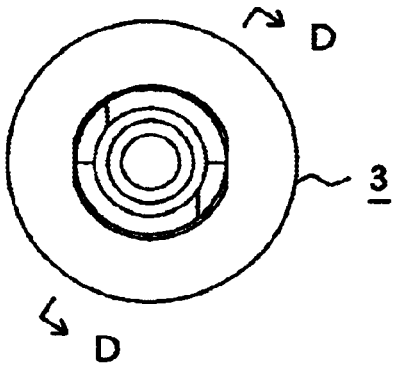
FIG. 12 is an end view of the barrel tip shown in FIG. 11.

In FIGS. 7 and 10, indicated at 143 are round holes bored by ejector pins disposed in a cavity to prevent a core pin from tilting in molding the stopper tube 14.

A rotary eraser feed mechanism 16 is inserted in a back part of the back barrel 2, and is detachably connected to a pressure-receiving member 17. A leg part 172 of the pressure-receiving member 17 is put on a back end part of the lead tank 4. A pressure-receiving part 171 of the pressure-receiving member 17 is detachably put on the eraser feed mechanism 16. A grip cover 18 is put on a grip part of the front barrel 1.

The operation of the double-chuck mechanical pencil in the first embodiment will be described. The eraser feed mechanism 16 is pulled to disconnect the eraser feed mechanism 16 from the pressure-receiving member 17 and to remove the same from the back barrel 2. A plurality of leads are supplied through the pressure-receiving member 17 into the lead tank 4, and then the eraser feed mechanism 16 is fitted in the pressure-receiving member 17. When pressure is applied to the back end of the eraser feed mechanism 16, the lead tank 4 is advanced together with the feed chuck 5 against the resilience of the return spring 8. When the feed chuck fixedly connected to the front end part of the lead tank 4 is thus advanced, the chuck ring 6 loosely put on the front part of the feed chuck 5 comes into contact with the inner step 93 (FIG. 4) of the sleeve bolster 9. When the feed chuck 5 is advanced further after the chuck ring 6 has come into contact with the inner step 93, the chuck ring 6 is separated from the chuck head of the feed chuck 5 to permit the three jaws of the feed chuck 5 are opened. Then, the lead is allowed to be advanced toward the holding chuck 10 by its own weight. When the pressure is applied repeatedly to the back end of the eraser feed mechanism 16, the feed chuck 5 holding the lead is advanced, the feed chuck 5 is retracted without retracting the lead to project part of the lead from the tip of the holding chuck 10.

After finishing writing, the lead can be retracted into the holding chuck 10 by pressing the tip of the lead against a paper sheet or the like with pressure applied to the back end of the eraser feed mechanism 16. When the leads contained in the lead tank 4 have exhausted, the eraser feed mechanism 16 is removed from the pressure-receiving member 17, and the lead tank 4 is replenished with leads.

Figure 15:
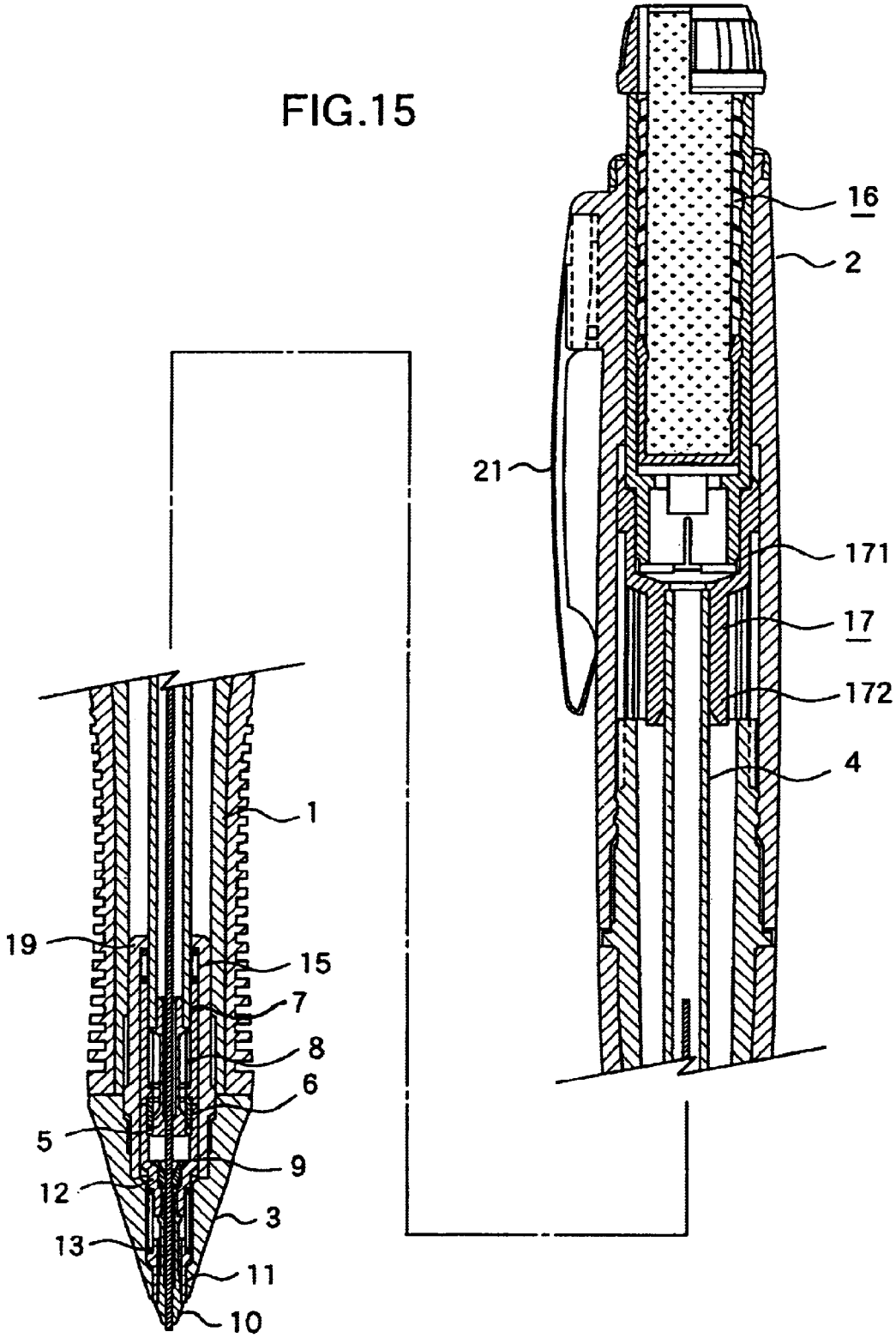
FIG. 15 is a longitudinal sectional view of a double-chuck mechanical pencil in a second embodiment according to the present invention.

Preferably, the resilience of the return spring 8 is higher than that of the tip spring 13, and the resilience of the tip spring 13 is higher than that of the cushioning spring 15. In this case, if the resilience of the cushion spring 15 is set to a level lower than that for absorbing an excessive pressure applied to the lead, since, as shown in FIG. 1 and 15, the total length of the cushion spring 15 is longer than that of the portion of the holding chuck, protruded from the opening of the barrel cap 3, the holding chuck 10 can fully be retracted within the barrel cap 3 advantageously when an impact is exerted on the holding chuck 10 due to the dropping of the double-chuck mechanical pencil.

Figure 16:
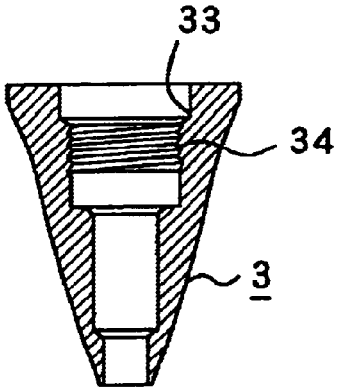
FIG. 16 is a longitudinal sectional view of a barrel cap shown in FIG. 15.
Figure 17:
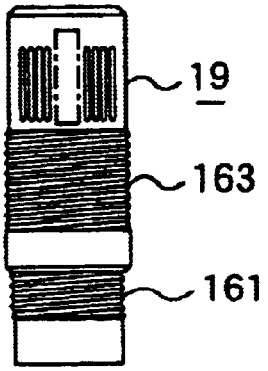
FIG. 17 is a front view of an intermediate connecting member.
Figure 18:
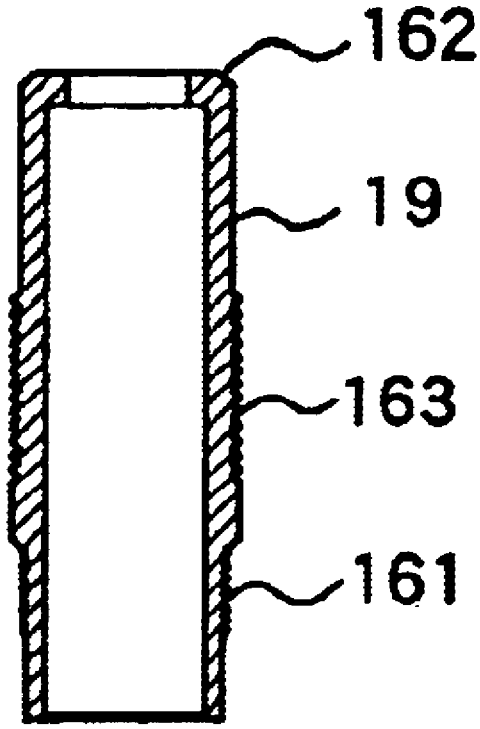
FIG. 18 is a longitudinal sectional view of the intermediate connecting member shown in FIG. 17.

FIGS. 15 to 18 show a double-chuck mechanical pencil in a second embodiment according to the present invention. The double-chuck mechanical pencil in the second embodiment is provided with a barrel cap 3 formed by turning. Therefore, the double-chuck mechanical pencil in the second embodiment is suitable for small-lot production and facilitates changing models. As shown in FIG. 16, the barrel cap 3 is tapered toward its tip, and steps including a step 33 are formed in the barrel cap 3. Since the barrel cap 3 shown in FIG. 16 has a simple shape as compared with the barrel cap 3 shown in FIG. 13, a small lot of barrel caps like the barrel cap 3 shown in FIG. 16 can be manufactured by turning without using a mold.

The barrel cap 3 is provided with an internally threaded part 34 at a distance from its back end. An intermediate connecting member 19 has a front externally threaded part 161 which is screwed in the internally threaded part 34 of the barrel cap 3, a back externally threaded part 163 which is screwed in a front internally threaded part of the front barrel 1. Thus, the front barrel 1 and the barrel cap 3 are connected by screwing the front externally threaded part 161 in the internally threaded part 34 of the barrel cap 3, and screwing the back externally threaded part 163 in the front internally threaded part of the front barrel 1.

The barrel cap 3 is simple in shape, can be made by turning without using any mold, and the double-chuck mechanical pencil can be simply and surely assembled.

As apparent from the foregoing description, a barrel cap found to be defective in the manufacturing process can be easily replaced with a good one, the internal mechanism has a small outside diameter and hence the double-chuck mechanical pencil can be formed in a small outside diameter.

When the double-chuck mechanical pencil is dropped inadvertently and the broken lead is jammed in the chuck, the broken lead can be easily removed.

Since the mechanical unit is fastened to the barrel cap by twisting, the front barrel can be used in both a ballpoint pen and a mechanical pencil. Thus the double-chuck mechanical pencil can be manufactured at a high productivity and facilitates process management.

Since the double-chuck mechanical pencil is provided with a separate internal mechanism instead of a unit internal mechanism, the eccentricity (thickness deviation) of the molded parts including the sleeve bolster, the sleeve and the stopping tube can be reduced, and the alignment of the axes of the parts is facilitated.

When the preceding lead is worn out while the double-chuck mechanical pencil is used for writing and the succeeding lead needs to be fed, it is desirable that the feed chuck is kept centered in the barrel as far as possible while the feed chuck feeds the succeeding lead because a resistance work on the lead even in a state where the feed chuck is opened. For example, if the feed chuck is pressed obliquely in the lead tank or a high pressure that warps the lead tank is applied to the lead tank, the feed chuck vibrates to misalign the succeeding lead with the preceding lead and, consequently, the succeeding lead cannot be smoothly fed. Therefore the double-chuck mechanical pencil is provided with the long barrel cap, the stopper tube disposed in the back part to reduce the bend of the lead tank when a pressure is applied to the lead tank and to reduce the vibration of the feed chuck, and to feed the lead successfully.

The double-chuck mechanical pencil may be provided with the barrel cap formed by turning. Various types of barrel caps can be formed in small lots by turning.

Since the holding chuck is capable of absorbing shocks and is resistant to deformation and hence leads are not easily broken.

What is claimed is:

1. A double-chuck mechanical pencil comprising:

a barrel;

a barrel cap detachably screwed on a front end of the barrel;

a lead tank inserted in the barrel so as to be operated for longitudinal sliding in the barrel;

a feed chuck fixed to a front end of the lead tank;

a chuck ring loosely put on the feed chuck;

a sleeve interposed between the barrel cap and the feed chuck;

a sleeve bolster in contact with a front end of the sleeve;

a holding chuck fixed to a front end of the sleeve;

a return spring interposed between the sleeve and the lead tank;

a tip spring interposed between the barrel cap and the sleeve; and an intermediate connecting member having a front externally threaded part screwed in an internally threaded part of the barrel cap, and a back externally threaded part screwed in a front internally threaded part of the barrel.

* * * * *

UNITED STATES PATENT AND TRADEMARK OFFICE

CERTIFICATE OF CORRECTION

PATENT NO. : 6,783,292 B2
APPLICATION NO. : 10/265402
DATED : August 31, 2004
INVENTOR(S) : Arai et al.

It is certified that error appears in the above-identified patent and that said Letters Patent is hereby corrected as shown below:

In the claims:

Col. 6, Line 56, insert --bolster-- after "sleeve"

Signed and Sealed this

Thirtieth Day of March, 2010

David J. Kappos

David J. Kappos
*Director of the United States Patent and Trademark Office*